US005277226A

United States Patent [19]

Kuhlman

[11] Patent Number: 5,277,226

[45] Date of Patent: Jan. 11, 1994

[54] WATER LINE ADAPTER

[76] Inventor: Peter Kuhlman, 739 Hawthorn Cir., Lombard, Ill. 60148

[21] Appl. No.: 883,613

[22] Filed: May 14, 1992

[51] Int. Cl.[5] ..... F16K 11/14

[52] U.S. Cl. ..... 137/862; 137/801; 285/156; 285/354

[58] Field of Search ..... 137/861, 862, 801; 285/156, 8, 354; 251/148

[56] References Cited

U.S. PATENT DOCUMENTS

| | | | |
|---|---|---|---|
| 416,824 | 12/1889 | Butts | 285/156 X |
| 750,932 | 2/1904 | Baird | 285/156 X |
| 965,008 | 7/1910 | Perkins | 285/156 X |
| 1,466,592 | 8/1923 | King | 285/156 X |
| 2,297,966 | 10/1942 | Luff | 285/156 X |
| 2,975,983 | 3/1961 | Niebling | 137/861 X |
| 3,747,960 | 7/1973 | Bawa | 285/354 X |
| 3,831,983 | 8/1974 | Stickler | 285/156 X |
| 4,589,688 | 5/1986 | Johnson | 285/12 |

*Primary Examiner*—Martin P. Schwadron
*Assistant Examiner*—Kevin L. Lee
*Attorney, Agent, or Firm*—Bullwinkel Partners, Ltd.

[57] ABSTRACT

A water line adapter designed to convert a single water outlet line into a multiple outlet water line, with the adapter comprising a cubical body, a captive rotatable threaded nut attached to one face of the body, a first threaded member attached to the opposite face, and a second threaded member attached to another face. In one application, the adapter is attached to a shut-off valve by threading the captive rotatable nut over the threaded member of the shut-off valve. In this manner, a single outlet shut-off valve can be converted into a shut-off valve having two outlets. The adapter is particularly useful in providing a water supply to appliances such as ice makers, dishwashers and under-the-counter water filters.

4 Claims, 1 Drawing Sheet

WATER LINE ADAPTER

BACKGROUND OF THE INVENTION

Today's modern buildings, particularly residential buildings, often include many more water-using appliances than the buildings built a generation or more ago. Such appliances include ice makers, dishwashers, under-the-counter water filters and hot and cold water dispensers. Each of these appliances requires its own supply of water to operate. As a result, builders and plumbers are required to plumb an ever-increasing number of water lines to supply water to these appliances.

The most straightforward way to provide water to such appliances is to install a new water line, usually by tapping into an existing water line. Unfortunately, the time and effort required to tap into an existing water using conventional techniques can be difficult and time-consuming, and generally requires shutting off the water supply to the entire house or building at its source.

If the existing water line has a conventional two-way stop valve (commonly called a "stop") with an input line, a valve section and an output line (such as shown at 14 in the drawings), then the two-way stop can merely be replaced, with what is known as a three-way angle supply stop, which has two discharge ports rather than one. However, this method requires the additional expense of purchasing a new three-way valve, and also requires shutting off the water supply to the entire house or building.

SUMMARY OF THE INVENTION

It is, therefore, an object of the present invention to provide a simple, inexpensive water line adapter which a builder or plumber can install quickly and easily. A related objective is to provide a water line adapter that, when connected to a two-way shut-off valve, can convert a single water outlet line into multiple water outlet lines.

A further objective is to provide a water line adapter that can be installed without shutting off the water supply to the entire house or building.

A still further objective is to provide a water line adapter that can be used with copper or plastic tubing.

Yet another objective is to provide a simple and easy method for converting a single water outlet line having a two-way stop valve into a multiple water outlet line.

THE DRAWINGS

DETAILED DESCRIPTION OF THE INVENTION

Figure 1:
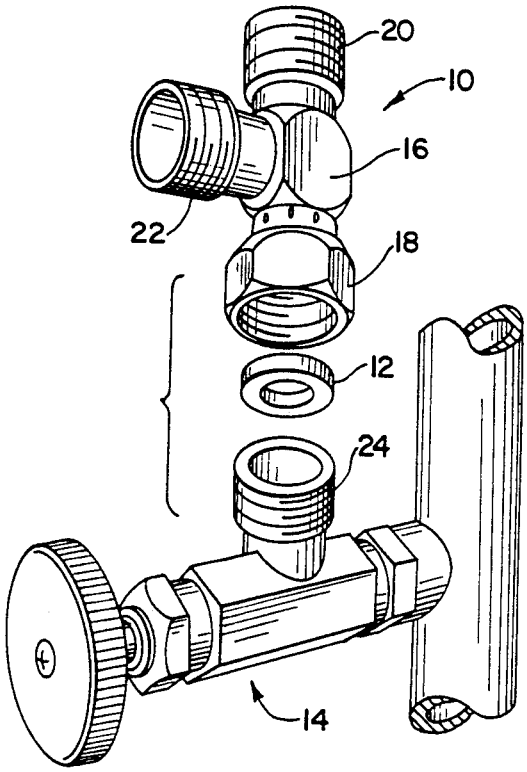
FIG. 1 is an exploded perspective view of the water line adapter of the present invention.

Turning to the drawings, there is shown in FIG. 1 the preferred embodiment of the present invention. The water line adapter 10 is shown in exploded view with a resilient washer 12, ready to attach to a conventional two-way shut-off valve 14.

Figure 3:
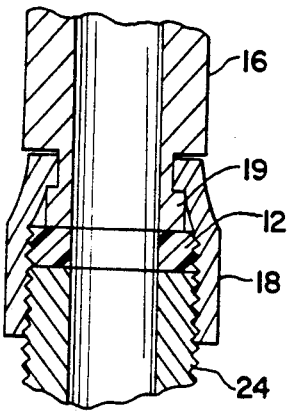
FIG. 3 is an enlarged sectional side elevation taken in the plane 3—3 of FIG. 2.

The body of the adapter 10 is a substantially cubical element 16 with beveled or chamfered edges, to one face of which is attached a captive rotatable internally threaded nut 18 secured to one face of the body 16 by means of shoulder 17 as shown in FIG. 3. Extending from the opposite face is a first threaded member 20, and extending perpendicularly from another face of the element 16 is a second threaded member 22. Preferably, the adapter 10 is formed of brass, although other suitable materials may be used with equal success. The adapter 10 attaches to the shut-off valve 14 by threading the swivel nut connection 18 over the male compression threads or flare threads 24 of the shut-off valve 14 until tight. When connecting the adapter 10 to a shut-off valve 14, the resilient washer 12 must be inserted into the swivel nut connection 18 prior to threading the adapter 10 onto the shut-off valve 14.

Shut-off valves having one water outlet are commonly used under household sinks. The shut-off valve, sometimes referred to as a two-way stop, is used to interrupt the supply of water to the sink, when, for example, the sink faucet is being replaced or repaired.

Figure 2:
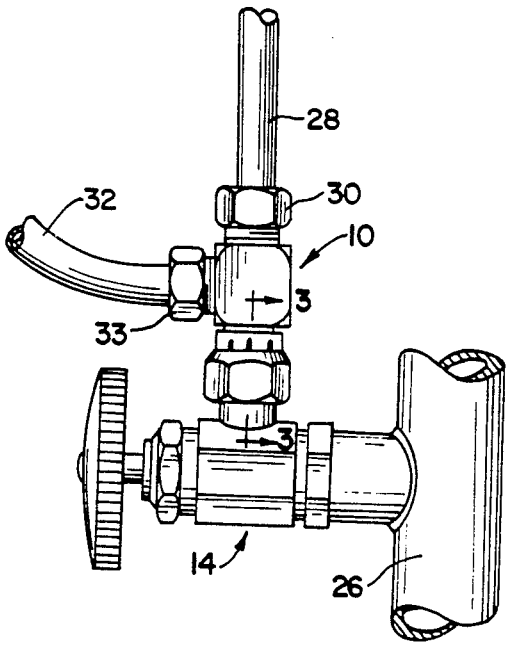
FIG. 2 is a side elevation of the water line adapter of FIG.1.

As is best illustrated in FIG. 2, a two-way stop having one water outlet can be quickly and easily converted to a stop having two water outlets by the addition of an adapter 10 according to the present invention. Prior to the attachment of the adapter 10, the shut-off valve 14 is connected to an existing water line 26, providing a two-way stop with one water outlet. The single water outlet typically supplies water to a faucet located on the sink.

By the use of the adapter 10, the stop which formerly had but one water outlet threaded fitting attachment member connections now has two. In the illustrated embodiment, a riser 28 leading to the sink faucet and which was previously connected directly to the stop 14 is now connected to the first threaded member 20 by a compression fitting 30. A second tube or riser 32 can then be connected to the second threaded member 22 for providing water to such appliances as an ice maker, a dishwasher, an under-the-counter water filter, or a hot or cold water dispenser. The tube 32 may be formed of copper, plastic or other suitable material. In practice, the first riser 28 may need to be shortened to accommodate the height of the adapter 10.

Although FIGS. 1 and 2 illustrate the adapter 10 before and after attachment to a two-way shut-off valve 14, it should be noted that the adapter 10 can used without a two-way shut-off valve. For example, the adapter 10 can be attached to any suitable male connection, including another adapter. When two adapters are used together, a single water line can be converted into a three-way water line.

I claim as my invention:

1. A water line adapter to be used in conjunction with a stop valve having a compression threaded connection for converting a single outlet water line into multiple outlets comprising a substantially cubical body, a captive rotatable threaded nut attached to one face of said body and which rotates to position the adapter in the direction of the water line, but when tightened is not subject to further rotating, said captive rotatable threaded nut directly attachable to the compression threaded connection of the stop valve, a first threaded member attached to the face of said body opposite said rotatable nut, and a second threaded member attached to another face of said body, said threaded members suitable for connection with copper or plastic tubing.

2. The water line adapter of claim 1 further comprising a resilient washer disposed inside said captive rotatable threaded nut.

3. The water line adapter of claim 1 in which the adapter body is formed of brass.

4. In combination, a water line, a stop valve having a compression threaded connection, and a water line adapter connected to said stop valve and comprising a substantially cubical body, a captive rotatable threaded nut with a threaded bore attached to one face of said body and which rotates to position the adapter in the direction of the water line, but when tightened is not subject to further rotating, said captive rotatable threaded nut directly attachable to the compression threaded connection of the stop valve, a first threaded member attached to the face of said body opposite said captive rotatable threaded nut connection, and a second threaded member attached to another face of said body, said threaded members suitable for connection with copper or plastic tubing.

* * * * *